US005727262A

United States Patent [19]

Littlejohn

[11] Patent Number: 5,727,262

[45] **Date of Patent: *Mar. 17, 1998**

[54] BATHROOM VENTILATOR

[76] Inventor: George C. Littlejohn, 2329 Carrington Dr., Ellenwood, Ga. 30049

[ * ] Notice: The terminal 17 months of this patent has been disclaimed.

[21] Appl. No.: 283,219

[22] Filed: Jul. 29, 1994

[51] Int. Cl.[6] ..... E03D 9/052; E03D 9/02

[52] U.S. Cl. ..... 4/213; 4/223

[58] Field of Search ..... 4/213, 209 FF, 4/222, 223

[56] References Cited

U.S. PATENT DOCUMENTS 3,763,505 10/1973 Zimmerman ..... 4/213 X
4,025,325 5/1977 Goodwin, Jr. ..... 4/209 FF
4,853,981 8/1989 Hunnicutt, Jr. ..... 4/213
4,876,748 10/1989 Chun ..... 4/213
5,125,119 6/1992 Munoz ..... 4/213

*Primary Examiner*—Robert M. Fetsuga

[57] ABSTRACT

Disclosed is an apparatus that can be placed on top of a conventional toilet or mounted on a wall. The apparatus is comprised of an AC-DC timer fan or blower, self-contained reservoir of liquid disinfectant, and a perfumer and deodorizing unit. The apparatus has two extendable, flexible, and connecting hoses. These hoses are extended from the base of the apparatus and are secured at the base or rear of the nozzle attachment. One hose is a conduit of the liquid disinfectant. The second hose enters into the fan or blower chamber of the apparatus through two detachable fumigating filters and out of a perfumer into the ambient.

7 Claims, 2 Drawing Sheets

BATHROOM VENTILATOR

BACKGROUND OF THE INVENTION

There have been devices made and discarded to further satisfy the function of the indoor use of the bathroom facility. However, it is important to note that to the present time, the use of the facility still has a lot to be desired. Irrespectively, one of the most important functions of the facility that of providing a receptacle for the elimination of bodily wastes and the resultant fumigation of the area leaves something to be desired. For example, to aerate the area, the use of an exhaust fan is usually mounted on the ceiling or wall. This appears to have very limited effect.

The following patent reflects the state of the art of which applicant is aware:

U.S. Pat. No. 3,805,304 Naoaki Ikehata

This patent shows a system wherein an exhaust fan is located at the base of the facility. An electrical switch conveniently located on an air exhaust conduit generally rings the toilet opening, and an inter-connecting conduit discharges to the main waste line.

Also, we have Carl E. Cannon, Edward W. Sowards, and Bonifacio C. Valarao whose concepts are a cure of this very common problem, but are very expensive and complicated to put to general use.

By way of contrast, the instant application is directed to and claims a device adapted for eliminating the foul odors and sanitizing the toilet in a much simpler mode of operation. This invention also provides a convenient means of deodorizing and fumigating the facility.

The following patents have a facsimile in function and appearance:

U.S. Pat. No. 4,933,995 Carl E. Canon, Apr. 3, 1989

U.S. Pat. No. 4,933,996 Edward W. Sowards, May 25, 1989

U.S. Pat. No. 4,583,250 Bonifacio C. Valarao, Sep. 4, 1985

U.S. Pat. No. 3,805,304 Naoaki Ikehata—Japan, May 1, 1972

U.S. Pat. No. 4,553,274 George M. Yui—Canada, Oct. 16, 1984

U.S. Pat. No. 5,138,726 John G. Campbell—USA, Jan. 8, 1990

U.S. Pat. No. 4,924,532 Domenick Pennestri—USA, May 9, 1989

U.S. Pat. No. 3,816,073 Charles H. Miller—USA, Dec. 1, 1972

OBJECTIVE AND SUMMARY OF THE INVENTION

Accordingly, it is the objective of this invention to provide an apparatus which allows for the use of the bathroom facility in a more sanitary and pleasant manner.

It is a further objective of this invention to provide an apparatus to help ventilate the said facility more efficiently than conventional venting systems that are generally mounted on the ceiling or wall.

It is yet a further objective of this invention to provide an apparatus that is productive and cost effective to manufacture, extremely durable in construction, and formed from suitable material that is easy to install.

These and other objectives will be made manifest when considering the following detailed specifications when taken in conjunction with the appended drawing figures.

BRIEF DESCRIPTION OF THE DRAWINGS

FIG. (1) is a perspective frontal view of the invention with integrated components.

FIG. (2) is a schematic side and dorsal view to show how the invention is made wall mountable.

Figure 1:
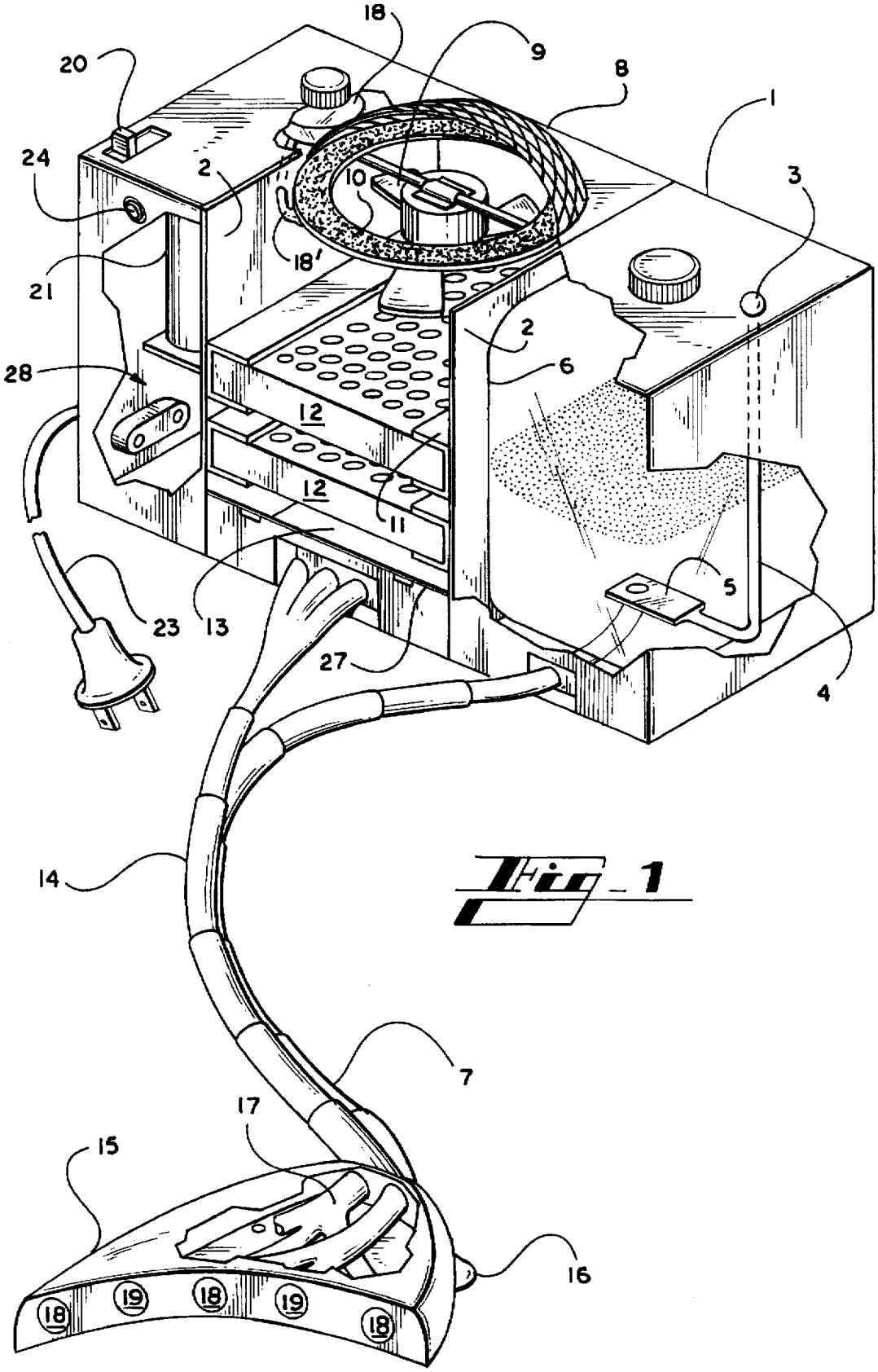

FIG. (3) is the total view of the overall scale of the invention.

DESCRIPTION OF THE PREFERRED EMBODIMENT

Referring now to the drawing, wherein, like referenced numerals refer to like parts throughout the various drawing figures. Reference numerals direct the location of the apparatus to the present invention.

The apparatus FIG. 1 has a first portion of substantially rectangular configuration. The said apparatus FIG. 1 has three sections: power, exhaust, and liquid, all separated by walls (2).

Figure 2:
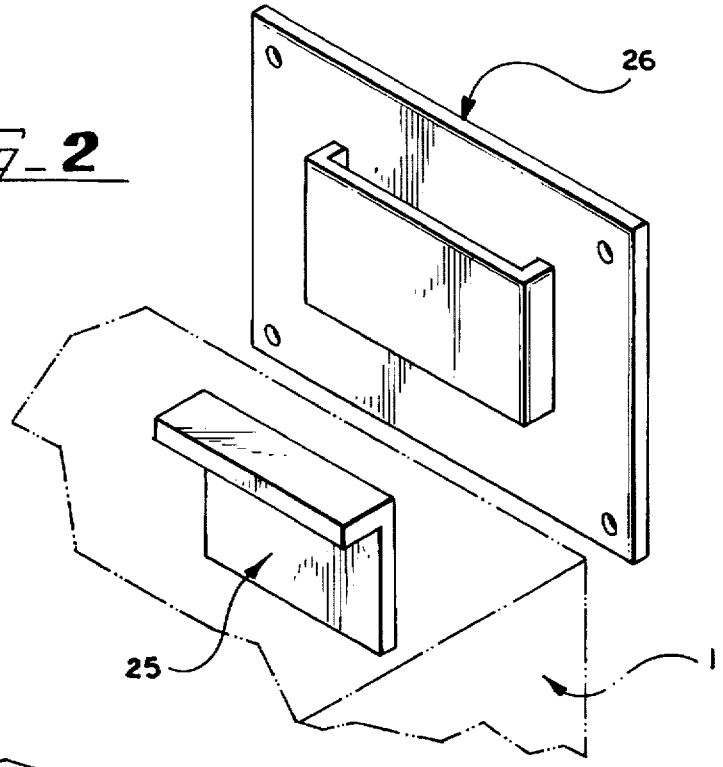
Figure 3:
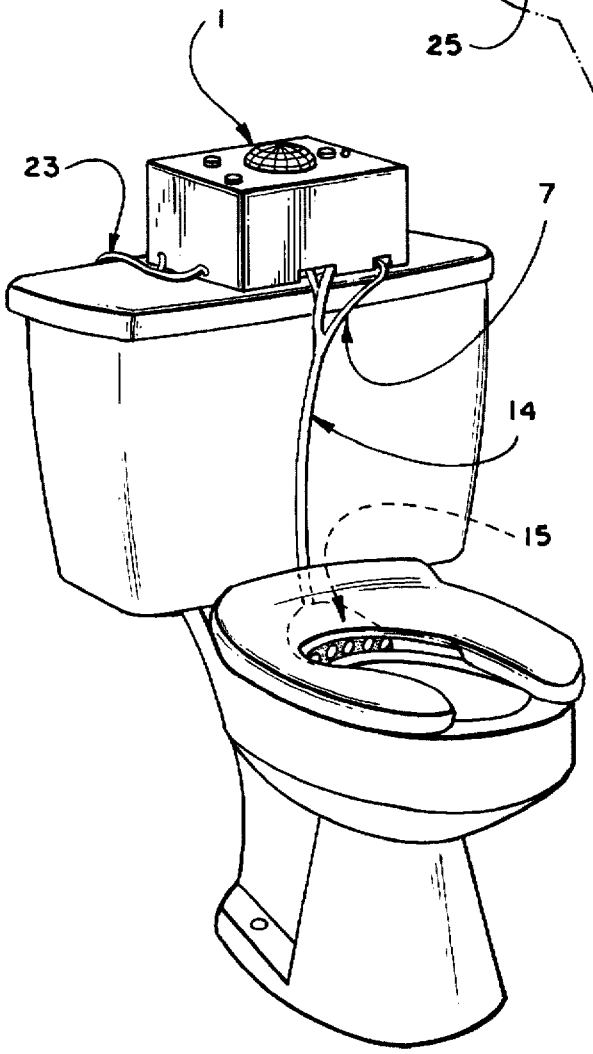

The apparatus (1) is to be placed on the top of a conventional toilet tank FIG. 3 or wall mounted as displayed in FIG. 2 (25–26). The said apparatus (1) is equipped with a pair of adjustable and flexible communicating hoses (14) (7). Both said hoses are secured to the rear of the nozzle attachment (17). The first said hose (7) is a conduit of liquid disinfectant from the container reservoir (6). The first said hose (7) extends to the bowl through opening (19) of the nozzle (15) by means of a flow-way connector valve (5) and rod (4). The manual control knob (3) maintains the fluid communication with the said nozzle (15). The said nozzle (15) is secured to the rim by suction devices (16). The second communicating hose (14) is a conduit of foul air. The communicating hose (14) extends from the air inlet ports (18) within the nozzle (15) to an inlet (13) at the base of the apparatus. Air flows through two removable fumigating filters (12) before being received by the fan or blower (9). The filtering slots (11) (27) of the said removable filters (12) are affixed inside the chamber of said fan (9) housing. Near the top of the said fan (9) is the perfumer. The said perfumer consists of a circular member of absorbent material (10) within a vented hose. The said perfumer is supplied through a filler top (18) through the filler line (18') to the said absorbent material (10). The perfumer is located above the said fan (9) but within the fan housing. The fan (9) housing is covered on top with a mesh cover (8) for safety. The power source AC-DC switch (21) of the apparatus (1) is comprised of a rechargeable battery (22) and the power cord (23). The said power cord (23) can be stored in the side (28) of said apparatus (1). The LED (24) indicates the power condition of the battery (22).

The timer switch (20) is an automatic venting feature for conscious-free effort during toilet usage.

I claim:

1. A ventilation and disinfection apparatus for use with a toilet having a tank and bowl, comprising:

a housing defining an interior having three separated compartments;

an electric power source disposed within a first of said compartments;

an exhaust unit disposed within a second of said compartments, said exhaust unit including an intake port, at least one filter, an electric fan and an exhaust port;

a liquid disinfectant unit disposed within the third compartment, said disinfectant unit including a disinfectant reservoir communicating with a manually controlled valve;

a nozzle securable to communicate with an interior of said toilet bowl, said nozzle including at least two inlet ports and at least two outlet ports in respective flow communication;

a first flexible hose connecting said exhaust unit inlet port and one of said nozzle outlet ports; and a second flexible hose connecting said reservoir valve and the other of said nozzle inlet ports, whereby, said toilet bowl may be ventilated by operation of said exhaust unit and disinfectant may be supplied to said bowl by operation of said disinfectant unit.

2. The apparatus of claim 1, wherein said housing is mountable on said toilet tank.

3. The apparatus of claim 1, and further comprising a bracket for mounting said housing to a wall.

4. The apparatus of claim 1, wherein said exhaust unit outlet includes a perfumer for scenting the ventilated air.

5. The apparatus of claim 1, wherein said power source includes a rechargeable battery.

6. The apparatus of claim 1, wherein said power source includes an AC/DC switch.

7. The apparatus of claim 1, wherein the operation of said exhaust unit is controlled by a timer.

* * * * *